US006270156B1

(12) United States Patent
Metzger et al.

(10) Patent No.: US 6,270,156 B1
(45) Date of Patent: Aug. 7, 2001

(54) FOLDING CHAIR

(75) Inventors: Andrew Metzger, Belle Plaine, KS (US); Lee W. David, Penfield, NY (US); Richard J. Sylvester; Scott W. Miller, both of Rochester, NY (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/536,671

(22) Filed: Mar. 28, 2000

(51) Int. Cl.[7] ..... A47C 4/47
(52) U.S. Cl. ..... 297/16.2; 297/45; 297/59
(58) Field of Search ..... 297/16.1, 16.2, 297/45, 59; 248/164, 431, 432

(56) References Cited

U.S. PATENT DOCUMENTS 647,171 * 4/1900 Wiles ..... 297/45 X
3,136,272 * 6/1964 Sprigman ..... 297/16.2 X
4,547,015 * 10/1985 Wakimoto ..... 297/16.2
4,652,047 * 3/1987 Chan ..... 248/431 X
5,975,626 * 11/1999 Aycock ..... 297/16.2 X

FOREIGN PATENT DOCUMENTS

514306 * 5/1954 (BE) ..... 297/16.2
2010342 2/1990 (CA) .

* cited by examiner

*Primary Examiner*—Peter R. Brown
(74) *Attorney, Agent, or Firm*—Kramer Levin Naftalis & Frankel LLP.

(57) ABSTRACT

A folding indoor/outdoor chair that folds in multiple directions includes a seat and backrest assembly supported by a collapsible or foldable chair support assembly. The seat portion of the seat and backrest assembly includes pivot hinges that allow the seat portion to fold in a first direction. The seat and backrest members are comprised of a flexible material or fabric that easily folds in multiple directions when the chair support assembly and seat member are folded along their pivot axes. The resulting chair folds in a compact space while providing increased support and stability to the user.

19 Claims, 7 Drawing Sheets

FOLDING CHAIR

FIELD OF THE INVENTION

The present invention is generally directed to a folding chair and, more specifically, to a folding indoor/outdoor chair adapted to fold in multiple directions for easier transport and compact storage.

BACKGROUND OF THE INVENTION

The portability and ease of storage of folding chairs makes their use popular in a wide variety of applications, including use as supplemental seating for indoor and outdoor events or as portable outdoor seating in a suburban backyard, park or beach.

Folding chairs are known in the prior art that include a chair support assembly that folds in more than one direction to form a compact design. However, such known chairs include a separate flexible, unframed seat member that is removably mounted to the foldable chair support assembly. While the unframed seat member folds compactly together with the support assembly, the seat member does not provide the chair user the necessary support or comfort. Moreover, a separate backrest member is not provided only exacerbating the discomfort of the chair user.

Thus there exists a need in the art for a chair adapted to fold in at least two directions into a compact space that also provides enhanced comfort and seat and back support. There exists a further need for a folding chair adapted to fold in at least two directions into a compact space while supporting a seat member and a backrest member. There exists still a further need for a folding chair adapted to fold in at least two directions into a compact space while supporting a foldable seat member and a foldable backrest member.

SUMMARY OF THE INVENTION

In accordance with an exemplary embodiment of the present invention, a folding chair is provided comprising a seat member and backrest member mounted on a foldable chair support assembly that comprises a plurality of legs, a mounting collar having a plurality of guide openings wherein each leg of the plurality of legs extends through one of each guide hole of the plurality of guide holes and is pivotally mounted to the mounting collar to move between an open or unfolded position for supporting the chair and a folded position. The plurality of legs defining in the open position a first base for supporting the chair on a bearing surface and a second base for supporting the seat and backrest members.

In another aspect of the present invention, the seat and backrest members each include a pair of lateral support assemblies for reinforcing the seat and backrest members and stabilizing the folding chair.

In still another aspect of the present invention, the seat support assemblies each include a pivot point that together define an axis across which the seat member is folded in a first direction.

In yet another aspect of the present invention, the folding chair includes an additional pair of rear legs extending from the backrest lateral support assemblies for additional stability and support.

The above and other objects, features and advantages of the present invention will become readily apparent from the following detailed description thereof which is to be read in connection with the accompanying drawings.

DETAILED DESCRIPTION

Figure 1:
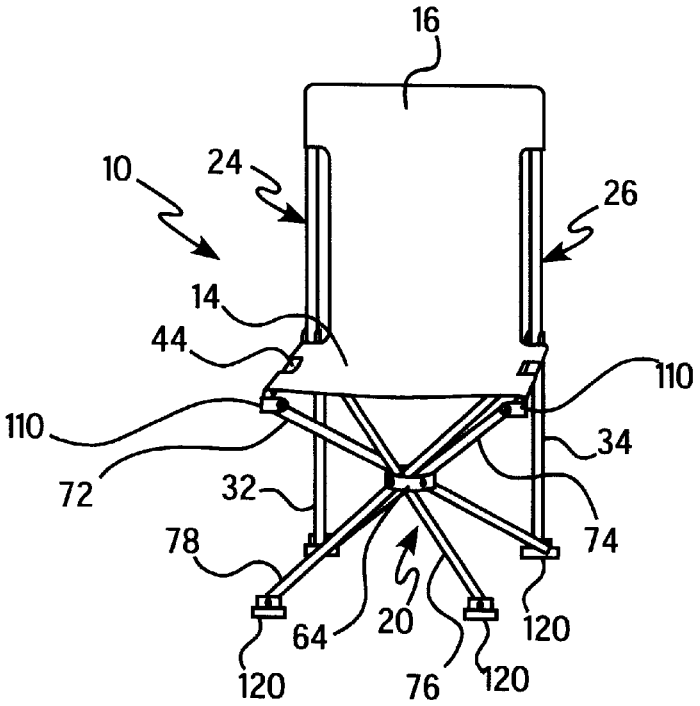
FIG. 1 is a front perspective view of a folding indoor/outdoor chair according to an exemplary embodiment of the present invention.
Figure 3:
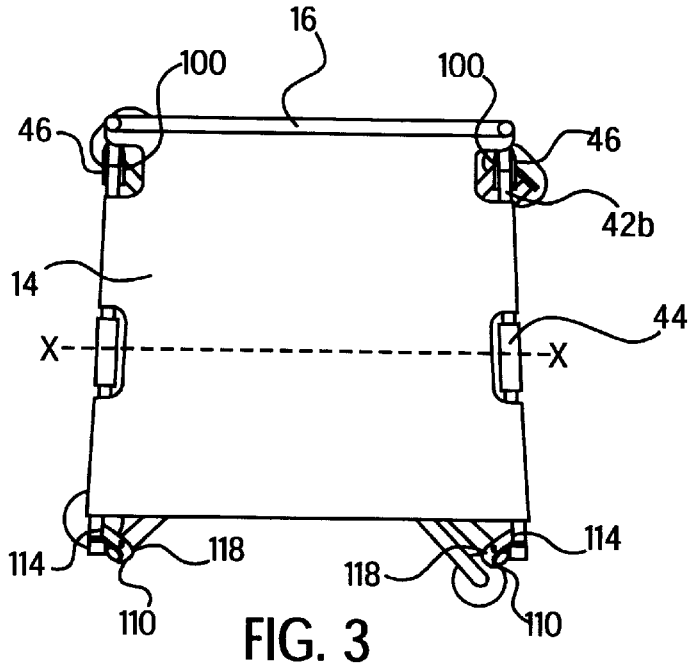
FIG. 3 is a top view of the folding indoor/outdoor chair.
Figure 4:
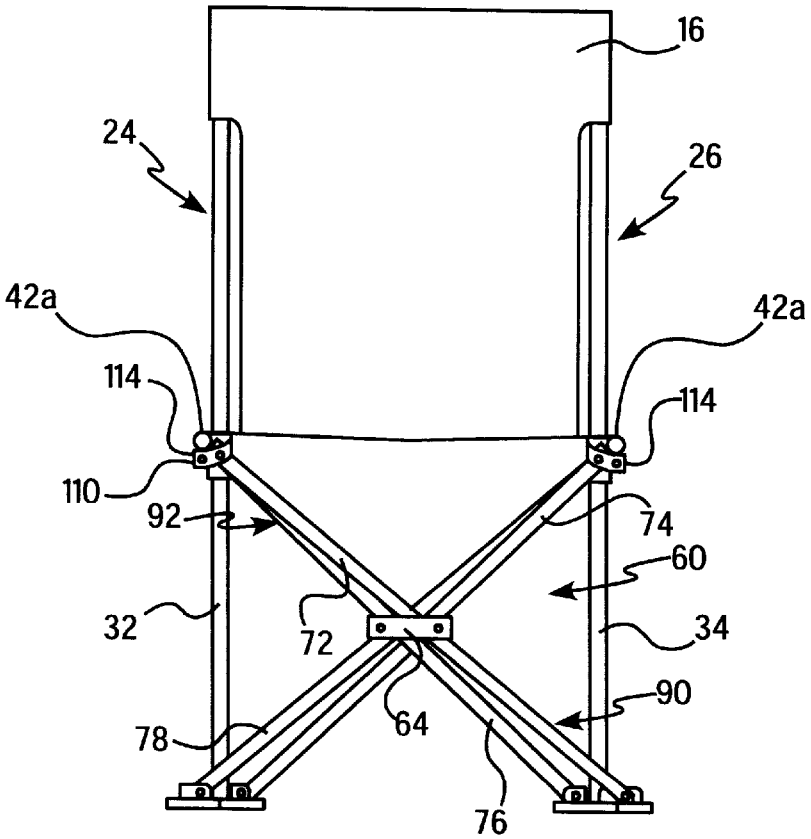
FIG. 4 is a front elevational view of the folding indoor/outdoor chair.
Figure 5:
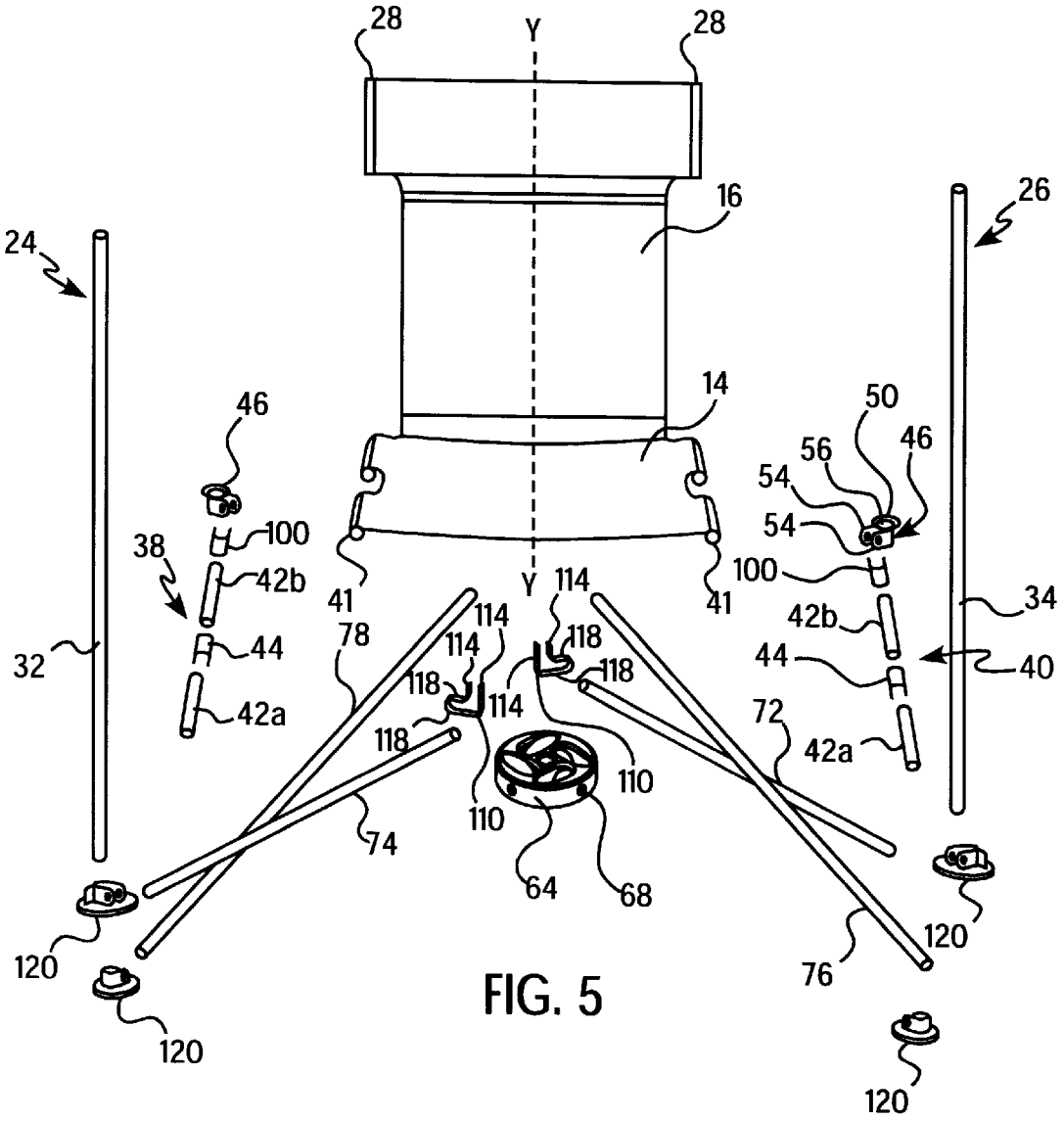
FIG. 5 is an exploded view of the folding indoor/outdoor chair.

Referring to FIGS. 1–5, a folding indoor/outdoor chair in accordance with an exemplary embodiment of the present invention is generally shown in an unfolded or open state as reference numeral 10. The folding chair 10 generally comprises a seat member 14 and back rest member 16 made of a flexible, durable fabric or the like. Since the chair 10 may be used outdoors, the fabric is preferably made of a weather resistant material. As shown in FIGS. 1 and 5, the fabric or the like 18 which comprises the seat and back rest members 14, 16 is preferably made as a single or integral piece thereby connecting the seat and backrest members 14, 16. The folding chair 10 further comprises a collapsible or folding chair support assembly, generally shown as reference numeral 20, for supporting seat member 14 and backrest member 16.

Figure 6:
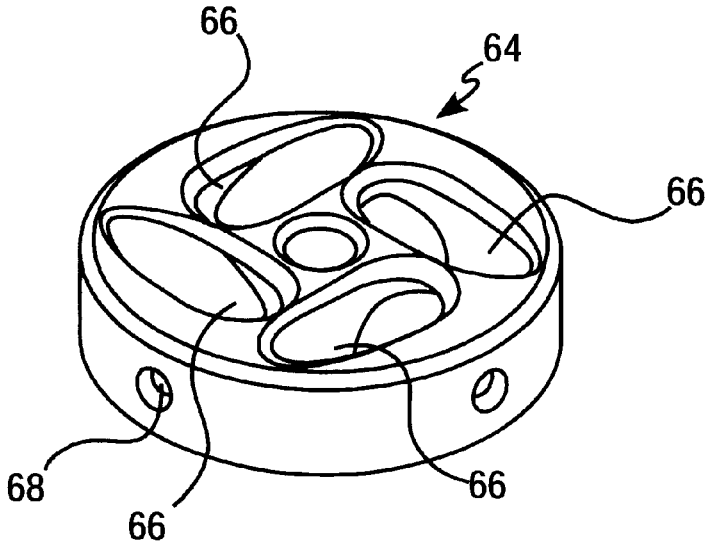
FIG. 6 is an perspective view of the mounting collar according to an exemplary embodiment of the present invention.

More specifically, the backrest member 16 includes a pair of rear support assemblies 24, 26, depicted in FIG. 6, that extend along outside edges of the backrest member 16 to provide support and structure to the backrest member 16 and ultimately also the chair 10. The rear support assemblies 24, 26 are preferably comprised of hollow metal tubes which are at least partly received by and supported within loops 28 formed in the portion of the fabric 18 that comprises the backrest member 16. The loops 28 are formed along the outside edges of the backrest member 16 by folding over a piece of the fabric 18 and stitching or riveting a seam therein. As further shown in FIGS. 1, 2 and 5, each rear support assembly 24, 26 extends downwardly from the backrest member 16 to define a pair of rear chair legs 32, 34 that are also preferably comprised of hollow metal tube. The rear chair legs 32, 34 may be an integral part of the rear support assemblies 24, 26 or separate members mounted thereto. As further shown in FIGS. 2 and 5, the rear support assemblies 24, 26 may be slightly bowed or curved to provide additional comfort to the user.

Similarly, the seat member 14 is reinforced by a pair of seat support assemblies 38, 40, depicted in FIG. 5, that extend along outside edges of the seat member 14. The seat support assemblies 38, 40 are also supported within loops 41 stitched or riveted in the fabric of the seat member 14. Each of the seat support assemblies 38, 40 includes a pair of hollow, metal tubes or members 42*a* and 42*b*, pivotally connected at a center by a hinge or joint 44, depicted in FIG. 5. Between the hinges or joints 44 is defined a folding axis X across which the seat member 14 folds in a first direction when the folding chair 10 is collapsed or folded.

Figure 2:
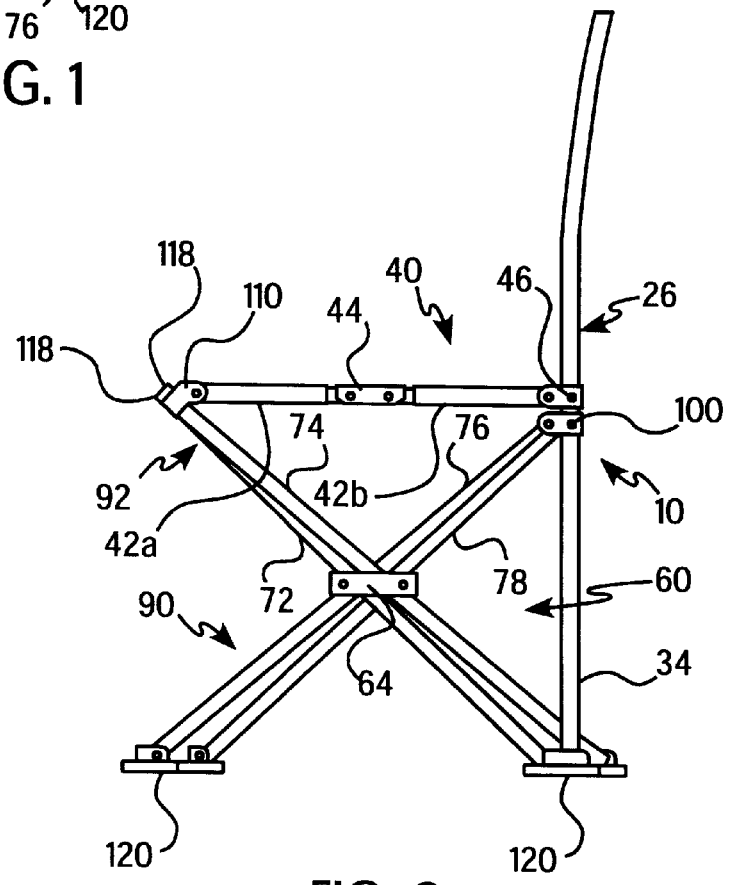
FIG. 2 is a side view of the folding indoor/outdoor chair.

Referring to FIGS. 2 and 5, seat member 14 which extends substantially perpendicular to backrest member 16 is pivotally mounted to the rear support assemblies 24, 26. Specifically, the rear support assemblies 24, 26 receive or mount a first pair of mounting slides 46, 46 for pivotally mounting seat member 14. As best shown in FIG. 5, the rear end of each of the seat support assemblies 38, 40 is pivotally fastened to a mounting slide 46.

The mounting slides 46, 46, depicted in FIG. 5, are comprised of an annular member 50 having a pair of laterally spaced flanges 54, 54 extending perpendicularly from an outer wall of the annular member 50. The opening 56 defined by annular member 50 is slideably mounted around each of the rear support assemblies 24, 26. As will be explained herein, when chair 10 is folded mounting slides 46, 46 slide upwardly along support assemblies 24, 26. Similarly, when chair 10 is unfolded slides 46, 46 slide down support assemblies 38, 40. The flanges 54, 54 and each of the ends of the seat support assemblies 38, 40 (i.e., the ends of 42*a*, 42*a*) include holes that accommodate a headed rivet or pivot pin to pivotally mount the ends of the seat support assemblies 38, 40 between flanges 54, 54. As further shown in FIGS. 1–5, and as will be described in detail, the seat support assemblies 38, 40 are also pivotally fastened to the chair support assembly 20, adjacent the front and rear ends of the chair 10.

In an exemplary embodiment of the present invention, the chair support assembly 20 comprises four leg members each also preferably made of a hollow metal tube. The leg members, collectively identified as reference numeral 60, pass through a mounting collar 64, depicted in FIGS. 6–8, having four guide openings or passages, each identified as reference numeral 66, for receiving the legs members 60. Furthermore, each of the legs which comprise the leg members 60 are pivotally fixed within a guide openings 66 such that one leg extends through each guide hole 66. Each of the legs may be pivotally secured to the mounting collar by, for example, a screw, headed rivet, pivot pin or bolt. In an exemplary embodiment, the screw, bolt, etc. is secured to a leg member through a hole or opening 68 that extends from an outer wall of the collar 64 into each of the guide openings 66.

Referring to FIGS. 1, 2 and 4, a first leg member 72 extends diagonally from a front end of the chair 10, through a guide opening 66 in collar 64, to a rear end of the chair 10; a second leg member 74 extends diagonally from the an opposite side of the front end of the chair 10, through a guide opening 66 in collar 64, to an opposite side of the rear end of the chair 10; a third leg 76 extends from a rear end of the chair 10, through a guide opening 66 in collar 64, to a front end of the chair 10; and the fourth leg 78 extends diagonally from an opposite side of the rear end of the chair 10, through a guide opening 66 the collar 64, to an opposite side of the front end of the chair 10. In an exemplary embodiment of the present invention the collar 64 is secured at approximately the midpoint of the leg members 60. Further the first and second legs 72, 74 are equal in length and slightly longer than third and fourth legs 76, 78 which are also equal in length.

Figure 7:
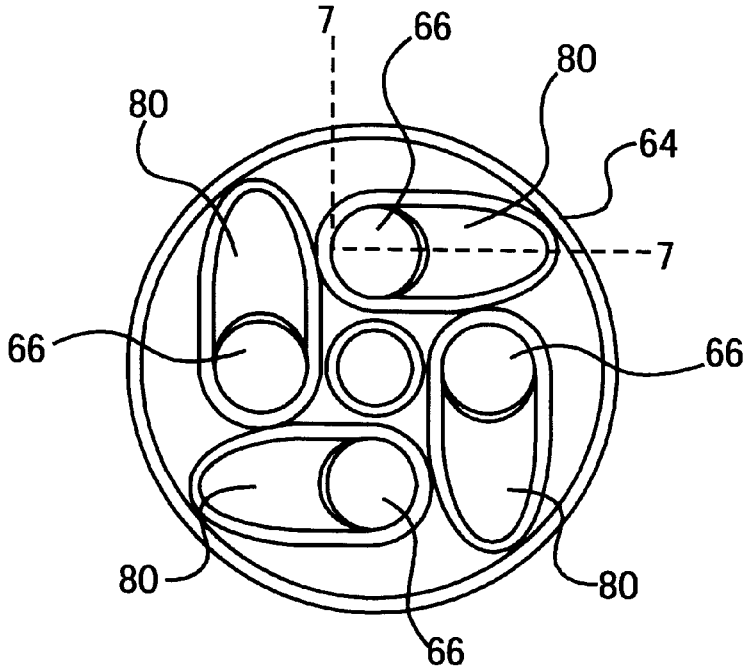
FIG. 7 is a top view of the mounting collar.
Figure 8:
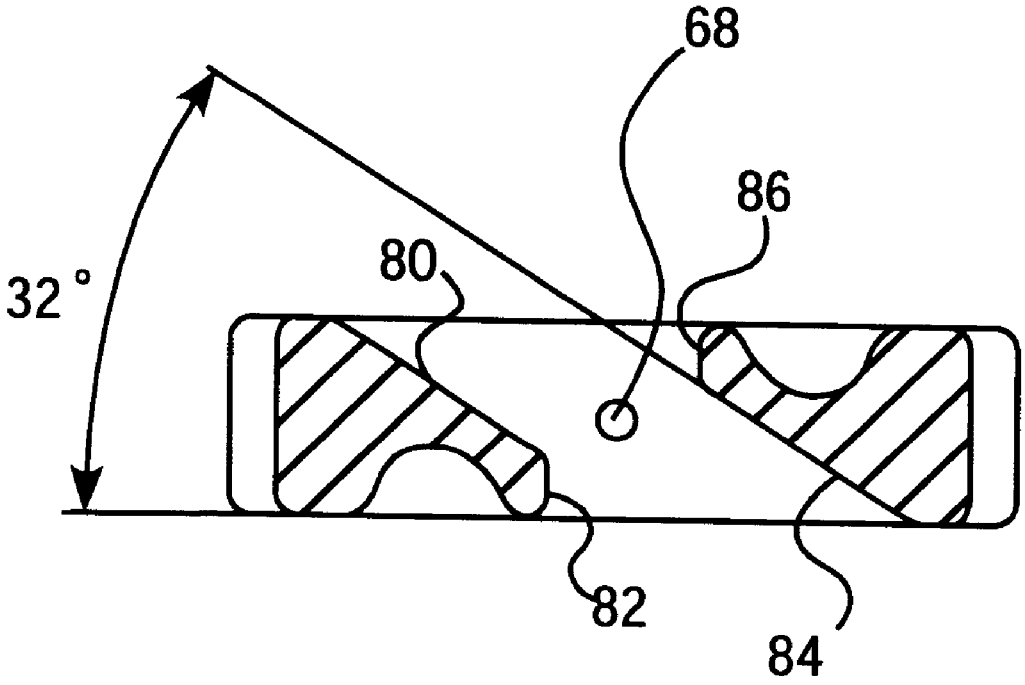
FIG. 8 is a view taken along the line 7—7 of FIG. 7.

Referring to FIGS. 6–8, each of the guide passages 66 defines an angular path which slopes downwardly from a top end of the collar 64 to a bottom end thereof More specifically, as shown in FIG. 8, the path is defined on one side by a first angled sidewall 80 which slopes from a top end of the collar 64 to a termination point adjacent a bottom end of the collar 64. At this termination point, the first angled sidewall 80 terminates in a first substantially vertical sidewall 82. Similarly, each guide passage 68 is bounded on an opposite side thereof by a second angled sidewall 84 that slopes from the bottom end of the collar 64 to a termination point adjacent the top end of the collar 64. At this termination point, the second sidewall 84 terminates in a second substantially vertical sidewall 86. In reality, as shown in FIG. 8, the first and second vertically oriented sidewalls 82, 86 define a substantially vertical annular path and first and second angled sidewalls 80, 84 define an angled or sloped annular path (approximately 32 degrees in an exemplary embodiment). The vertical and angled paths extend entirely through collar 64 within each guide opening 66. In this manner, each of pivotally mounted legs 72, 74, 76, 78 may swing or pivot within a guide opening 66 between a substantially vertical axis, as defined between sidewalls 82, 86 and a sloped axis as defined between sidewalls 80, 84.

In a fully open position or unfolded state, as shown in FIGS. 1, 2 and 4, the leg members 60 define a lower base, generally shown as reference numeral 90, for supporting the chair 10 on a bearing surface and an upper base generally shown as reference number 92 for supporting the seat member 14 and backrest member 16. Specifically, the upper ends of the third and fourth legs 76, 78 are pivotally fixed or mounted to the rear end of chair 10. As shown in FIGS. 2 and 5, a second pair of mounting slides 100, 100 are slideably mounted to rear chair legs 32, 34 adjacent to and below the first pair of mounting slides 46, 46. As depicted in FIG. 3, each mounting slide 100 of the second pair of mounting slides 100, 100 is radially offset from each mounting slide 46 of the first pair of mounting slides 46, 46. In particular, mounting slides 100, 100 are radially angled towared each other to pivotally mounts the top ends of the diagonally extending third and fourth legs 76, 78. Again, a pivot pin, headed rivet, screw or bolt may be used to pivotally mount these legs to mounting slides 100, 100.

At the opposite end of the folding chair 10 (i.e., the front end), first and second legs 72, 74 are mounted to a front end of seat support assemblies 38, 40 by connection joints 110, 110, depicted in FIGS. 1–5. The connection joints 110, 110 are adapted to mount legs 72, 74 to seat support assemblies 38, 40, respectively, along separate and distinct pivot axes. Specifically, connection joints 110, 110 include a first pair and a second pair of spaced flanges 114, 118 for separately and pivotally mounting seat support assemblies 38, 40 and legs 72, 74. The first pair of flanges 114 are pivotally mounted to the front end of members 42*a* and 42*b* of support assemblies 38, 40. The second pair of flanges 118, that are angularly and radially offset from the first pair of flanges 114, pivotally mount the top ends of legs 72, 74. In this manner, seat support assemblies 38, 40 and legs 72, 74 are free to pivot with respect to the connection joints 110, 110 independently of each other and in different directions thereby permitting the chair 10 to be folded in at least two directions for compact storage.

Figure 9:
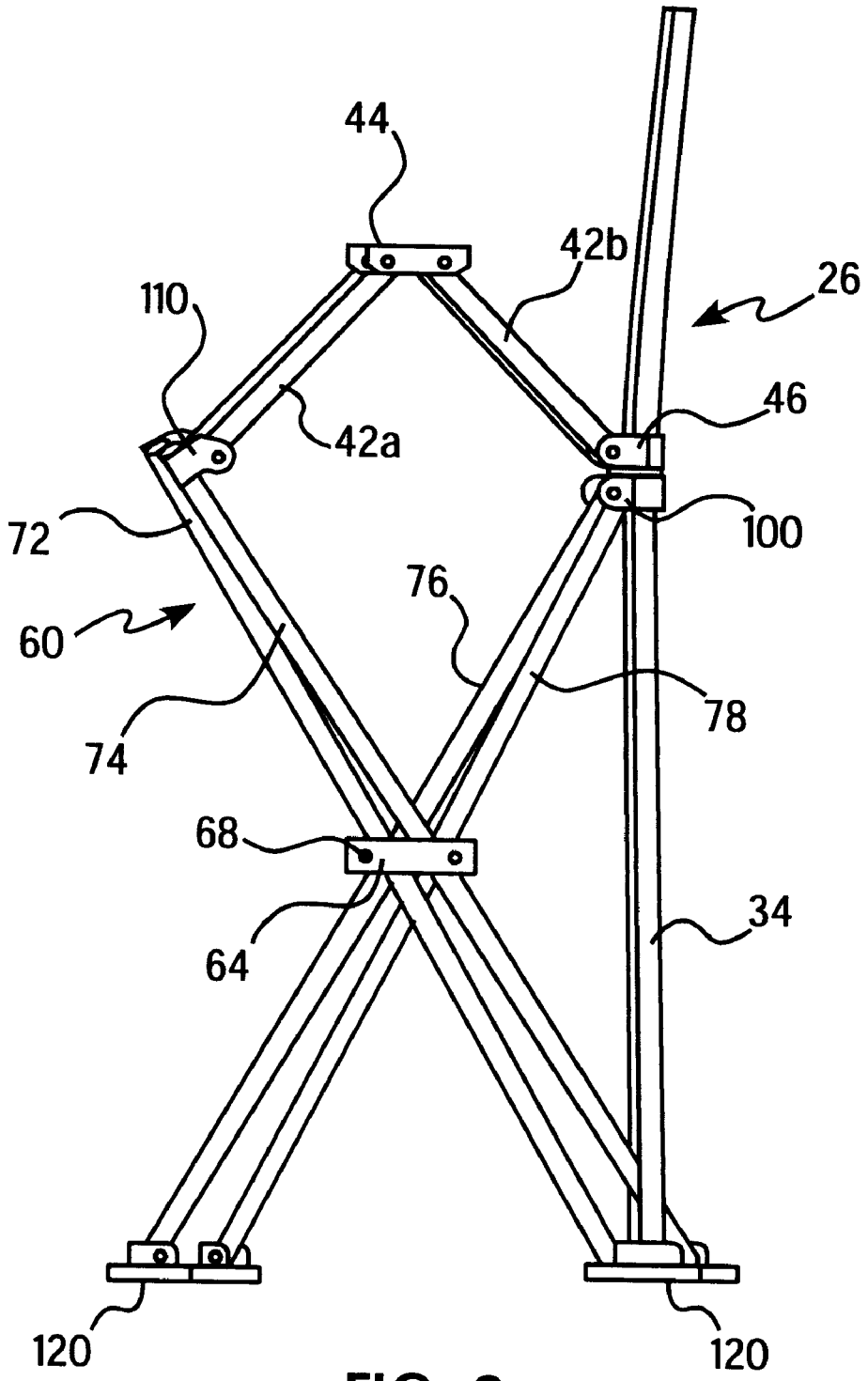
FIG. 9 is a side view of the folding chair according to an exemplary embodiment of the present invention in a partly folded state.
Figure 10:
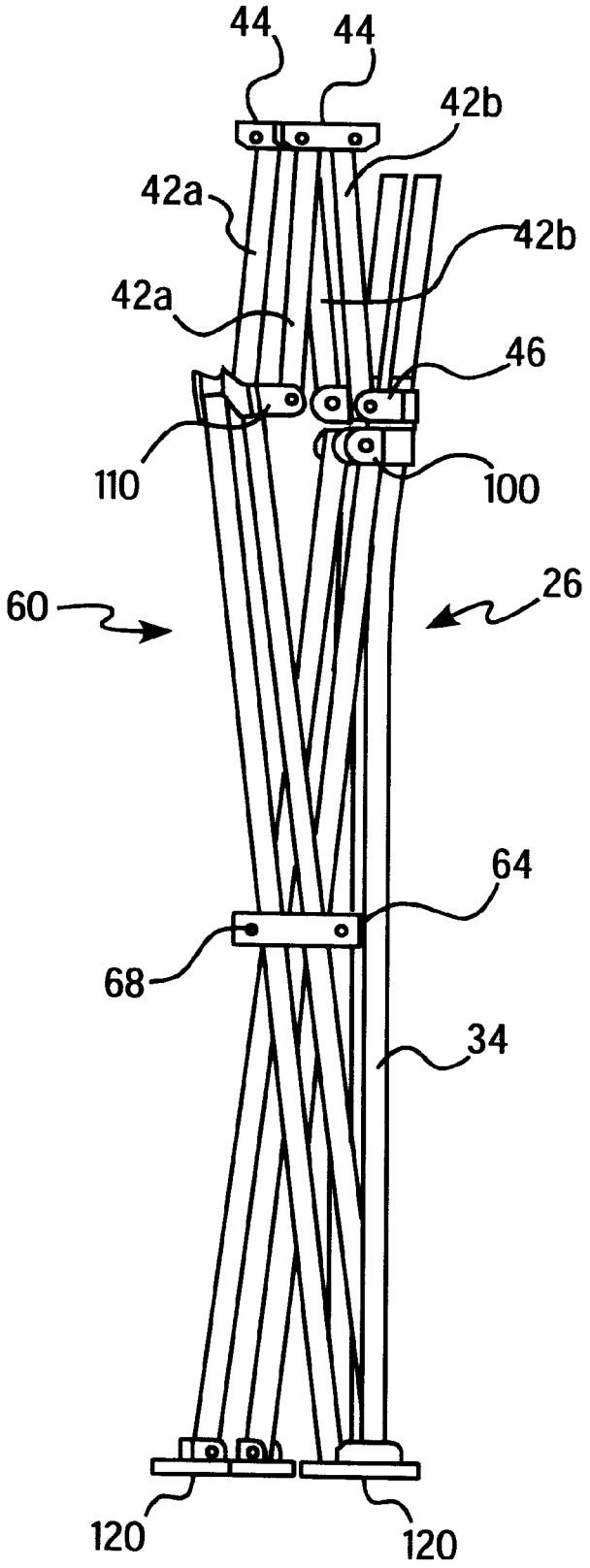
FIG. 10 is a side view of the folding chair in the folded state.

As best illustrated in FIGS. 9 and 10, according to an exemplary embodiment of the present invention, folding chair 10 folds in a first direction along axis X extending between hinges 44, 44 by lifting the front end of folding chair 10 causing hinge 44 to fold seat member 14 upwardly along the X axis. At the same time, flexible fabric 18 flexes or folds at the junction point between the seat and backrest members 14, 16. As shown in FIG. 9, during the folding process, support assemblies 38, 40 pivot at their ends within connection joints 110, 110 and mounting slides 46, 46, thereby folding the seat member 14 substantially in half.

Furthermore, this folding action causes first and second legs 72, 74 to pivot within mounting collar 64 from their open or angled position toward a collapsed or substantially vertical position. In turn, the action of legs 72, 74 causes legs 76, 78 to also pivot toward a collapsed or vertical direction. As legs 76, 78 are folded in the vertical direction, mounting slides 46, 46 and 100, 100 that pivotally mount seat member 14 and legs 76, 78, respectively, are driven upwardly along rear support assemblies 24, 26. At the same time, legs 72, 74, 76, 78 collapse inwardly toward each other, causing flexible fabric or material to fold in half along an axis Y, as depicted in FIG. 4. In the fully folded state, mounting slides 46, 46 and 100, 100 have moved toward a top end of the backrest member 16, legs 72, 74, 76 and 78 have folded into a substantially vertical orientation and members 42*a* and 42*b* have also folded into a substantially vertical orientation.

It has been shown that by providing folding chair 10 with a backrest member 14 with rear support assemblies 24, 26, a seat member with folding seat support assemblies 38, 40 and a collapsible support assembly 20, folding chair 10 folds compactly in two directions while providing enhanced seat and back support. In an exemplary embodiment of the present invention, the stability of chair 10 may be even further enhanced by equipping each of the legs 72, 74, 76, 78 with feet or pedestals 120, having an enlarged bearing surface, as depicted in FIG. The feet 120 are pivotally connected to the bottom ends of each of the legs. Preferably, the feet 120 that are pivotally mounted to legs 72, 74 also support the bottom ends of rear chair leg 32, 34 as shown in FIGS.

Having described exemplary embodiments of the present invention with reference to the accompanying drawings, it will be appreciated that the present invention is not limited to those precise embodiments, and that various changes and modifications can be effected therein by one of ordinary skill in the art without departing from the scope or spirit of the invention as defined by the appended claims.

What is claimed is:

1. A folding chair comprising:

a seat member and a backrest member;

a chair support assembly for supporting said seat and backrest members comprising:

a pair of rear leg members extending from the backrest, a first pair of intersecting leg members and a second pair of intersecting leg members, a top end of each of the second pair of intersecting leg members including a pivotal mount slidably engaging a middle section of one of the pair of rear leg members, and each of said first pair of intersecting leg members being pivotally mounted at a top end thereof to said seat member such that said first pair and second pair of intersecting leg members extend diagonally between a front end of said folding chair and a rear end thereof; and a means for pivotally mounting said first and second pairs of intersecting leg members for movement between fully open and fully closed positions, the means for pivotally mounting intermediately bracing the plurality of leg members.

2. The folding chair of claim 1 wherein said seat member includes a pair of lateral support assemblies, each lateral support assembly having a pivot point for folding said seat member and supported at the front end by the top end of one of the first pair of intersecting leg members and at the rear end by the backrest member.

3. The folding chair of claim 3 further comprising joints for pivotally mounting said first pair of intersecting leg members to said support assemblies.

4. The folding chair of claim 3 wherein said joints comprise first and second pairs of flanges to pivotally mount said first pair of intersecting leg members and pivotally mount said support assemblies.

5. The folding chair of claim 1 wherein said means for pivotally mounting said first and second pairs of intersecting legs includes four guide openings extending entirely through said means.

6. The folding chair of claim 1 wherein said seat member includes at least one pivotal mount slidably engaging said backrest member for pivoting a back end of said seat member between a substantially perpendicular position and a substantially parallel position relative to the pair of rear leg members extending from said backrest member.

7. The folding chair of claim 1 wherein said seat member and said backrest member each comprises a durable, flexible fabric and said seat member includes a pair of lateral support assemblies, each of the pair of lateral support assemblies of the seat member including at the rear end a pivotal mount slidably engaging one of the pair of rear leg members and including at the front end a pivotal mount connected to one of the top ends of the first pair of intersecting leg members.

8. The folding chair of claim 7 wherein said fabrics are secured to said support assemblies with loops formed within said fabrics.

9. A chair assembly comprising;

a foldable backrest member having first and second opposed lateral support assemblies extending along outer edges of said backrest member;

a foldable seat member having first and second opposed lateral support assemblies extending along outer edges of said seat member and including pivotal mounts slidably engaging middle sections of the first and second opposed lateral support assemblies extending along the outer edges of said backrest member;

a collapsible chair support assembly comprising:

a mounting collar having a plurality of guide openings;

a plurality of legs each having top ends and bottom ends, each leg of said plurality of legs extending through one guide hole of said plurality of guide holes and each said leg being pivotally mounted to said mounting collar to move between a folded and an unfolded position, the top ends of two of said plurality of legs including pivotal mounts slidably engaging middle sections of the first and second opposed lateral support assemblies extending along the outer edges of said backrest member;

means for pivotally connecting said top ends of said plurality of legs to at least one of said seat and backrest members; and said plurality of legs defining in said open position a first base for supporting said chair and a second base for supporting said seat and backrest members.

10. The chair assembly of claim 9 wherein said seat support assemblies include pivot joints for permitting said seat member to fold along an axis defined by said pivot joints.

11. The chair assembly of claim 10 wherein said seat support assemblies each comprise a pair of hollow metal tubes connected by said pivot joint.

12. The chair assembly of claim 9 further comprising a pair of rear legs extending from said lateral support assemblies and connecting to the bottom ends of two of the plurality of legs for providing additional support and stability to said chair assembly.

13. The chair assembly of claim 12 wherein said fabric comprises loops for securing said fabric to said lateral seat support assemblies and said lateral backrest support assemblies.

14. The chair assembly of claim 10 further comprising a plurality of feet, each foot of said plurality of feet being mounted to each leg of said plurality of legs for providing an enlarged bearing surface for supporting said chair assembly.

15. The chair assembly of claim 10 wherein said seat member and backrest member comprise a flexible, durable fabric for outdoor use of said chair assembly.

16. A folding chair comprising;

a foldable seat and backrest assembly, said seat and backrest assembly comprising a durable, flexible fabric having support assemblies for stability and support;

a chair support assembly comprising:

a mounting collar having a plurality of guide openings;

a plurality of legs having top ends and bottom ends, each leg of said plurality of legs extending through one of the guide openings of said plurality of guide openings and each said leg being pivotally mounted to said mounting collar to move between an unfolded position and a folded position;

a plurality of joints for pivotally connecting each of said top ends of said plurality of legs to one of a seat member and a backrest member of said seat and backrest assembly each of said top ends pivotally connected to the backrest member of said seat and backrest assembly slidably engaging the support assembly of the backrest member; and said plurality of legs defining in said open position a first base for supporting said folding chair on a bearing surface and a second base for supporting said seat and backrest assembly.

17. The folding chair of claim 16 wherein said fabric comprises loops for securing said fabric to said support assemblies.

18. The folding chair of claim 16 further comprising a pair of rear legs extending from said seat and backrest assembly and connecting to the bottom ends of two of the plurality of legs for providing additional support and stability to said folding chair.

19. The folding chair of claim 16 further comprising a plurality of feet, each foot of said plurality of feet being mounted to each leg of said plurality of legs for providing an enlarged bearing surface for supporting said folding chair.

* * * * *